United States Patent [19]

de Carteret

[11] 4,055,921

[45] Nov. 1, 1977

[54] REGLETS AND ASSOCIATED COMPONENTS

[76] Inventor: Arnold Edward Francis de Carteret, 16/21 Harrison Stret, Neutral Bay, New South Wales, Australia, 2089

[21] Appl. No.: 627,352

[22] Filed: Oct. 30, 1975

[30] Foreign Application Priority Data

Nov. 19, 1974 Australia ..... 9672/74

[51] Int. Cl.[2] ..... E04D 13/14; E04B 1/54

[52] U.S. Cl. ..... 52/61; 52/62

[58] Field of Search ..... 52/58–62, 52/396, 98, 402, 403, 400, 711; 428/122; 40/440, 441

[56] References Cited

U.S. PATENT DOCUMENTS

| | | | |
|---|---|---|---|
| 1,842,586 | 1/1932 | Davidson | 428/122 |
| 2,260,438 | 10/1941 | Cheney | 52/60 |
| 2,853,748 | 9/1958 | Kessler | 49/441 |
| 3,527,013 | 9/1970 | Kruschwitz | 428/83 |
| 3,793,795 | 2/1974 | Annand | 52/61 |
| 3,846,948 | 11/1974 | Dallen | 52/396 |
| 3,981,108 | 9/1976 | Berg | 52/98 |

FOREIGN PATENT DOCUMENTS

| | | | |
|---|---|---|---|
| 1,252,603 | 12/1960 | France | 52/403 |
| 1,456,972 | 9/1968 | France | 52/62 |
| 569,954 | 6/1945 | United Kingdom | 49/441 |

*Primary Examiner*—James L. Ridgill, Jr.
*Attorney, Agent, or Firm*—Finnegean, Henderson, Farabow & Garrett

[57] ABSTRACT

This invention relates to an improved reglet comprising an elongate channel member defined by first and second parallel transversely spaced wall members each connected along one longitudinal edge to a connecting wall, the other longitudinal edge of each wall member having latching face means defined by a plurality of ridges and grooves for engaging with and securely retaining a component inserted between the wall members.

6 Claims, 14 Drawing Figures

REGLETS AND ASSOCIATED COMPONENTS

This invention relates to improvements in Reglets and associated components.

During the construction of buildings it is necessary to provide some means for attachment of flashing as a means of weather protection at the joints between various parts of the building. Accordingly therefore, it is an object of this invention to provide an improved reglet together with associated components which provide a substantially more economic and more efficient means of applying flashing to a building.

The invention also has application in other fields, for example, in situations where it is necessary to instal a shock-absorbing cushion strip around the interior walls of a lift, and like places, where damage to the wall surfaces may occur by bumping or collision by trolleys and like types of implements. Similarly, the invention is also applicable to other situations such as boats where it is necessary to have a cushion material around the hull, or piers and docks, both marine and loading docks.

In one general form the invention resides in a reglet comprising first and second wall members arranged and disposed in transversely spaced longitudinal alignment and connected to each other along adjacent longitudinal edges by a web to form a channel shaped structure, the free longitudinal edge of at least one of said wall members having an inwardly stepped portion including a portion perpendicular to the wall defining an abutment facing inwardly of the channel and a plurality of ratchet like elements extending along at least one wall member in the region of the longitudinal edge thereof.

Figure 1:
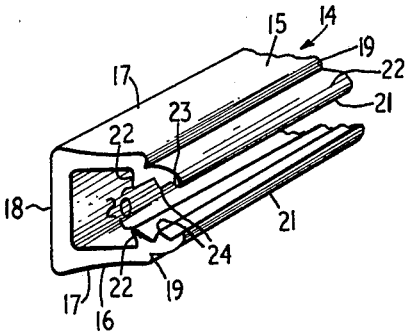
Figure 2:
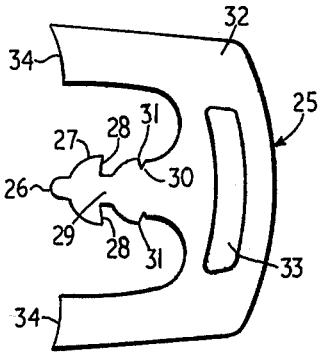
Figure 3:
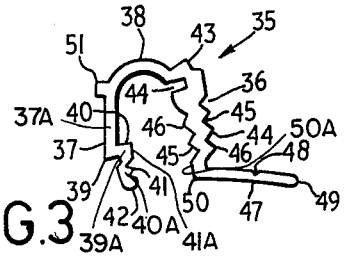
Figure 4:
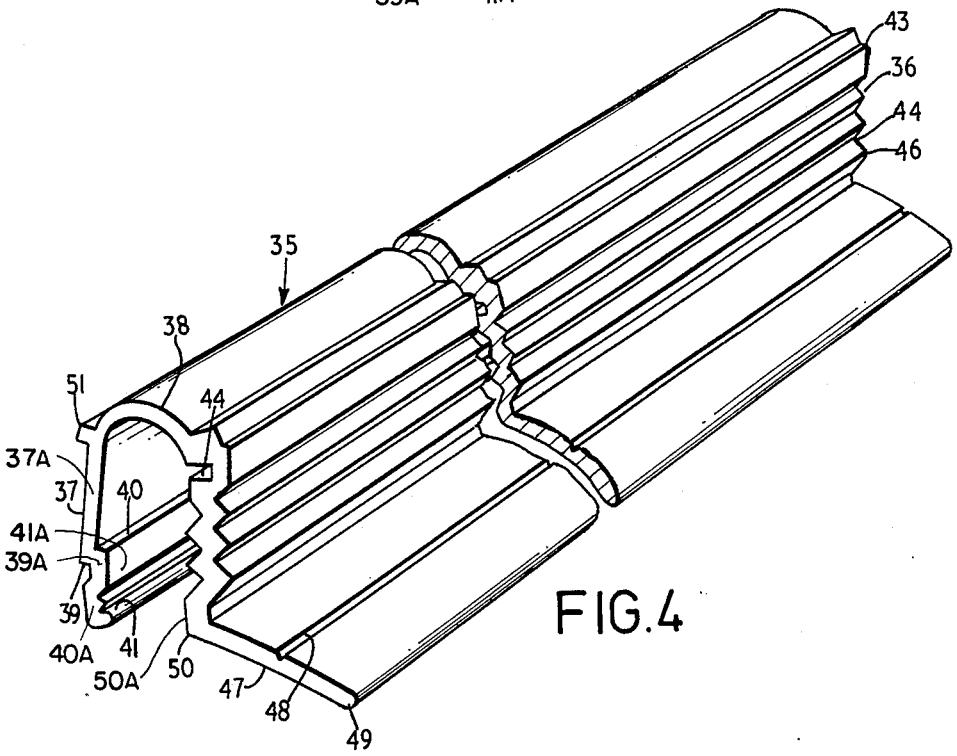
Figure 5:
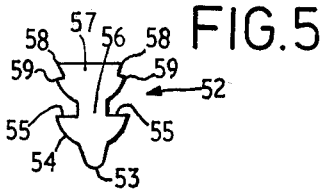
Figure 6:
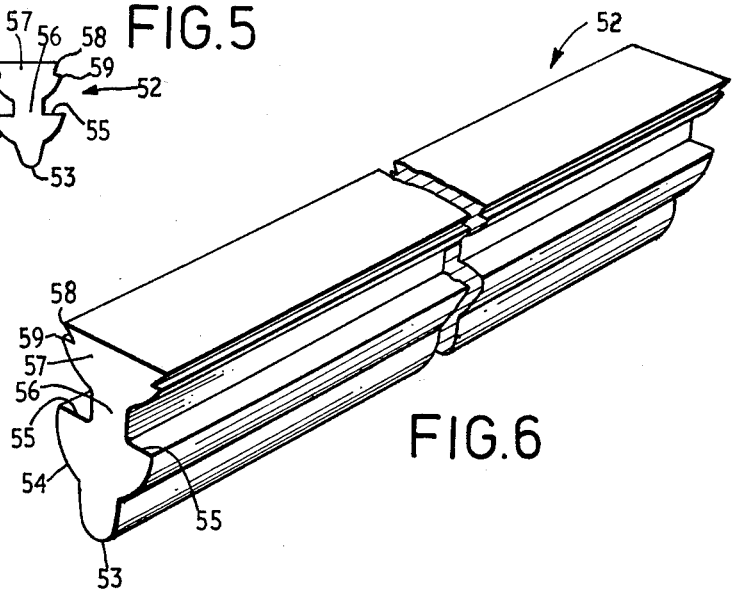
Figure 7:
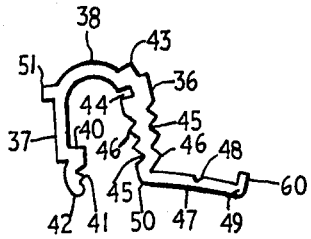
Figure 8:
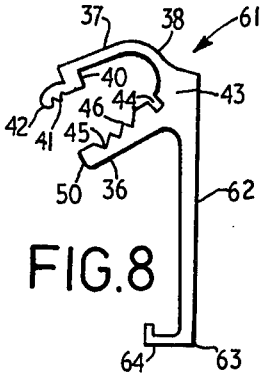
Figure 9:
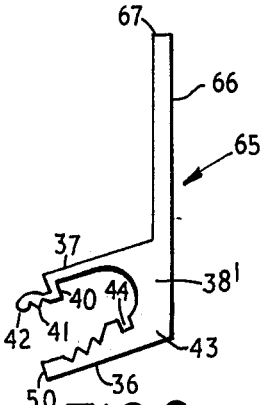
Figure 10:
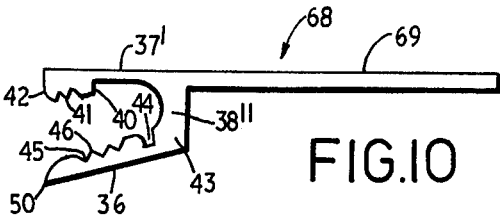
Figure 11:
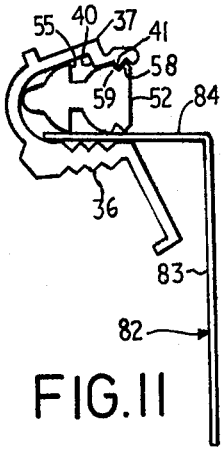
Figure 12:
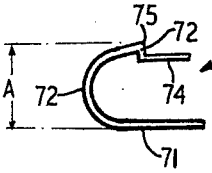
Figure 13:
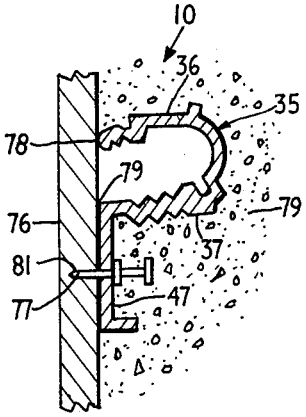
Figure 14:
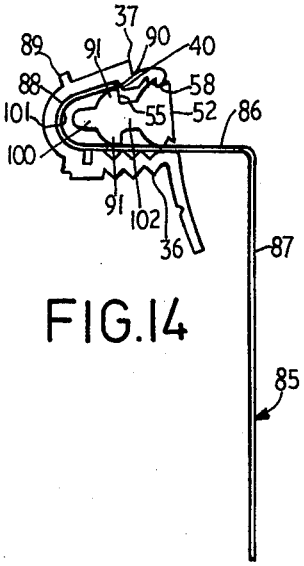

Notwithstanding any other forms that may fall within its scope a preferred form of the invention together with variations thereof will hereinafter be described with reference to the accompanying drawings of which, FIG. 1 is a perspective illustration of a basic form of the invention applicable for use in connection with shock-absorbing type rubbing strips, FIG. 2 is a shock-absorbing type of rubbing strip applicable for use in conjunction with the reglet of FIG. 1, FIG. 3 is a cross-sectional view of another form of the reglet according to the invention, FIG. 4 is a perspective illustration of the reglet of FIG. 3, FIG. 5 is a cross-sectional illustration of a reglet wedge according to the invention, FIG. 6 is a perspective illustration of the wedge of FIG. 5, FIG. 7 is a cross-sectional illustration of a variation of the reglet of FIG. 3, FIG. 8 is a cross-sectional illustration of another form of reglet according to the invention, FIG. 9 is a cross-sectional illustration of yet another form of the reglet, FIG. 10 is a cross-sectional illustration of a reglet for use in conjunction with brick and mortar constructions, FIG. 11 is a cross-sectional illustration showing the relationship between the wedge of FIG. 5, Reglet of FIG. 7 and one form of flashing suitable for use in conjunction with the invention, FIG. 12 is a cross-sectional illustration of a reglet connection in accordance with the invention, FIG. 13 is a cross-sectional fragmental illustration of a wall section and a former illustrating how to reglet of FIG. 7 is installed during forming of a wall structure, and FIG. 14 is a cross-sectional illustration of the reglet of FIG. 3 with one form of flashing installed therein.

Referring now to FIG. 1, in a broad form the invention is applicable to a number of different types of uses and accordingly may vary in configuration according to the type of use. The type of reglet 14 shown in FIG. 1 is applicable for use in mounting shock-absorbing resilient rubbing strips and comprises parallel spaced side walls 15 and 16 connected to each other along lateral edges 17 by an end wall or web 18.

In this particular form of the invention the free longitudinal edges 19 of each side wall 15 and 16 includes a portion 20 which projects inwardly towards the opposite side wall and has attached thereto an extended portion 21 providing latching faces 22 which are disposed in opposition to the end wall 18. The extended portion 21 has a curved outer surface 22 which terminates at the apex of a first toothed ratchet like portion 23 and provides the means whereby a second toothed ratchet like portion may be disposed between the latching face 22 and the first ratchet like portion 23.

Preferably the reglet 14 is integrally formed by extrusion in a suitable thermoplastic material.

In use, this particular form of the reglet may be attached to a surface by screwing or nailing through the end wall 18 so that a resilient shock-absorbing cushion type rubbing strip 25 (FIG. 2) may be attached thereto.

This rubbing strip 25 may be formed in a pliable resilient thermoplastic material and comprises a nose portion 26 projecting from a wedge like portion 27 having abutment faces 28 which terminate at a stem 29 projecting from a portion 30 having latching members 31. The portion 30 is connected to a U-shaped body portion 32 which may if required be provided with a hollow core 33.

In use, once the reglet 14 (FIG. 1) has been attached to a surface a suitable length of rubbing strip 25 is cut and then positioned adjacent the reglet 14 so that the nose 26 is located between the portions 21 of the reglet.

The installer need only then push the rubbing strip into the reglet until the abutment surfaces 28 are located behind the faces 22 of the reglet and the latching portions 31 are engaged with the ratchet like members 24 and the end surfaces 34 of the rubbing strip are positioned in compressed relationship against the surface to which the reglet has been attached. Thus, it will be seen by those skilled in the art that once the installation has been completed no attachment means will be visible to the naked eye.

The arrangement described in connection with FIGS. 1 and 2 is applicable to a number of different types of installations and may be utilised in connection with the buffer strips required in vehicle loading docks, piers and marine docks and may also be applied to the hull of a boat or to the rubbing strips used on the sides of motor vehicles.

The form of the reglet illustrated in FIGS. 3 and 4 is applicable for use in conjunction with the attachment of flashing to formed concrete wall constructions in buildings.

This form of the reglet 35 comprises parallel spaced second and first side walls 36 and 37 respectively which are connected by a bent portion or web 38. Side wall 37 includes an elongated element 37A, the free longitudinal edge 39 of which is provided with an inwardly extending flange 39A defining an abutment face 40 to which a normally extending element or flange portion 40A is connected. The element or flange portion 40A includes a planar surface portion 41A and a plurality of ratchet-type members 41 which, as illustrated, have a depth less than the depth of the abutment face 40. The element 40A is angled slightly relative to side wall 37 to place lip or edge 42 slightly closer to the corresponding surface portion 50A of the opposite side wall 36 than the connection between element 40A and flange 39A as shown in FIG. 3 or element 37A.

The opposite side wall 36 is substantially equal in width to the overall width of wall 37 including element 40A has a different configuration and may be somewhat thicker in cross-section than the side wall 37. Thus side wall 36 is provided with a thickened portion 43 having a slot 44 which extends outwardly from the channel formed by the side walls 36 and the bent portion 38 for some distance through the side wall 36 at the junction between the bent portion 38 and the thickened portion 43.

The portion 44 of the side wall 36 has a sawtooth type formation providing a plurality of slots 45 and ridges 46 on both surfaces thereof and terminates with an attachment member or nailing flange 47 which extends laterally away from the side wall 36. This attachment portion is provided with a slightly recessed line 48 which extends therealong at a point between the end 49 and the connection 50 between the portion 47 and the side wall 36.

The opposite side wall 37 of the reglet 35 is provided with an outwardly projecting ridge 51, thus as may be seen from FIG. 4 the reglet has a shape and configuration relative to its lateral and longitudial dimensions which permits simplified production by extrusion in a suitable resilient thermoplastic material. The function of the ridges and grooves 46 and 44 and the projecting portion 51 respectively is to provide the means whereby the reglet may be cast securely into a formed concrete wall structure.

The reglet 35 of FIGS. 3 and 4 is adapted to be used in conjunction with the wedge 52 of FIGS. 5 and 6. This wedge comprises a nose portion 53 which extends from a domed latching portion 54 which is provided with latching faces 55 which terminate at a connection with a stem 56 which in turn is attached to a locking member 57 provided with latching portions 58 and 59.

In use, a flashing provided with a leg adapted to be received in slot 44 is positioned in the channel defined by the walls 36 and 37 and bent portion 38 respectively and the wedge is then pushed into the channel until the nose portion 53 abuts against the bent portion 38 whereupon further pressure is then applied to the wedge until the nose portion 53 distorts permitting one of the latching faces 55 to latch behind the face 40 of the reglet 35 and the ratchet like members 58 and 59 to engage with the complementary ratchet like members 41 on the portion 42 of the reglet to securely retain the flashing in position as shown in FIG. 11.

The form of the reglet illustrated in FIG. 7 is substantially the same as the form of FIG. 3. However, the attachment portion 47 is provided with an additional leg 60 which functions to ensure that when the reglet is cast into the concrete the attachment portion 47 will be retained in its cast position. This leg 60 may of course be provided with a sawtooth form or projections of some form to ensure correct anchorage.

The reglet form 61 of FIG. 8 varies only in respect of the manner in which it is attached to the wall or surface where the flashing is required. In this form the reglet 61 is provided with spaced side walls 36 and 37 and the bent portion 38 as with the forms illustrated and described in connection with FIG. 7 and FIG. 3 and the construction of these portions of the reglet is substantially the same except that the lug projecting from the wall 37 is not required and therefore not provided. Similarly the attachment portion 48 is also not required. The means by which this form of the reglet is attached to the construction is attachment portion 62 which is a planar element which is formed integrally with the thickened portion 43.

The planar element 62 extends laterally away from the bent portion 38 at an angle to the side wall 36. The bottom 63 of the planar element 62 is provided with a reverse lip 64 which provides added strength to the planar element 62 thus preventing warpage and twistage.

This form of the reglet is intended for use on stucco walls. In use the reglet 61 is attached to a surface closely adjacent the position in which the flashing is required. The attachment is performed by driving a nail, screw or like type of fastener through the planar element 62 into the surface to which it is to be attached. Mounting of the flashing by means of the wedge of FIG. 5 is achieved in the same manner as previously described in conjunction with FIGS. 6 and 11.

FIG. 9 illustrates a reglet 65 for use in attaching flashing to cement rendered surfaces. This form of the reglet is somewhat similar to the form illustrated in FIG. 8 with the exception that the planar element 66 extends away from the thickened portion 43 in the opposite direction and is integrally formed with the bent portion 38'. If necessary the upper end 67 of the planar element 66 may also be provided with a reverse lip in the same manner as the reverse lip of FIG. 8. However, in the form of the reglet shown in FIG. 9 the tendency for the planar portion to whip or twist is considerably less than the tendency of the planar element of FIG. 8 to whip or twist.

The reglet 68 of FIG. 10 is intended for use in brick and mortar installations and consequently has a different configuration for attachment purposes than any of the previous reglets described.

In this form the attachment portion planar element 69 is continuous with side walls 37' and is attached to the thickened portion 43 by means of a thickened bent portion 38'. Preferably the planar element 69 has a wave type form similar to that of the side wall 36 of FIG. 7 so that it will be positively secured and keyed into the mortar between the brick or block elements.

In use, the user constructs the wall of bricks or blocks bonded by mortar until he reaches the zone in which it is necessary to attach flashing. He may then position the reglet with the planar element 69 disposed in the mortar securing consecutive blocks or bricks. Flashing may then be attached in a manner similar to that described in conjunction with previous illustrations.

The forms of the reglet illustrated in FIGS. 8, 9 and 10 may, if required, have the leg 36 provided with ridges and grooves 46 and 45 respectively on both surfaces. However, preferably the leg 36 should take the form illustrated in these figures.

Referring now to FIG. 12, in use it may often occur that a number of lengths of reglet may be required to be installed in a continuous line, thus it is preferred they be aligned so that installation of the flashing may be achieved without any difficulty. In the present invention the aligning of the reglets is achieved by means of a connector 70 as illustrated in FIG. 12. This connector 70 comprises wall 71 connected by bent portion 72 to an inwardly projecting lip 73 to an opposite wall 74. The inwardly projecting lig 73 provides a latching surface 75 and the maximum overall dimension A of the walls 71 and 74 respectively should preferably be equal to, or slightly greater than, the spacing between the side walls of the reglet. In use, when it is required to align adjacent strips of reglet it is only necessary for the operator to cut a length of connector and push it between the side walls at the adjacent ends of the reglet so that the latching surface 75 locates behind the abutment face 40 thus maintaining the adjacent reglets in alignment whilst they are mounted for installation.

In use, as shown in FIG. 13, the reglet 35 is attached to a former 76 by means of nails 77 driven through the attachment member 47 at spaced intervals along the length of the reglet so that the ends 78 and 79 respectively of the side walls 36 and 37 abut against the former 76 in alignment with the attachment member 47 which is compressed against the former 76 by the nails 77 so that when the concrete 79 is poured it will surround the reglet 35 and retain it in the desired position. Once the concrete is set the former 76 is then pulled away from the wall 80 formed thereby and the nails 77 leaving the reglet in its casting position in the wall or structure. It is merely a case for an operator to walk along the wall with a pair of cutters cutting off the exposed ends 81 of the nails 77.

Installation of the flashing 82 as shown in FIG. 11 is then performed in the manner described in connection with FIG. 11.

The flashing 82 illustrated in FIG. 11 comprises a weather surface 83 having a wall 84 disposed at right angles to the weather surface 83 at the end of which is a flange or lip 85 which locates in the recess 44. Alternatively, the wall 84 may be provided with a return bent portion which conforms to the interior configuration of the reglet, the bent portion having a free longitudinal edge which locates behind the abutment face 40 so that when the wedge 52 is installed the dome latching portion 54 will be disposed in the bent portion of the flashing while latching elements 58 and 59 locate at one side in the ratchet type elements 41 and on the other side abut against the wall 84 thereby providing the flashing from slipping out of the reglet.

In some circumstances the user of the reglet according to the invention may not wish to use a continuous length of the wedge 52. In this case short portions of wedge 52 may be inserted into the reglet to retain the flashing at spaced intervals along the length thereof while the remaining area is filled with a suitable caulking material.

The form of the invention illustrated in FIG. 14 utilizes a reglet similar to that of FIG. 3. The flashing 85 however differs in that it comprises first and second legs 86, 87 respectively forming an L shape and an arcuate portion 88 which, in use, is received within the channel of the reglet.

The free end 90 of the portion 100 is arranged to latch in behind the abutment surface 40 while the nose 100 of the wedge 52 abuts the inner surface 101 of the arcuate portion.

A positive lock is obtained by virtue of the fact that the abutment face 55 of the wedge 52 locks behind the face 40 and wing portions 91 urge the legs 88 and 102 of the arc outwardly as discussed in conjunction with FIG. 11.

Preferably the wedge 52 of FIG. 5 is formed in a flexible resilient thermoplastic material such that during its insertion into the reglet portions 55, 58 and 59 will deflect to enable them to pass over the latching surfaces 40 and 41 of the reglet. This enables installation of the wedge 52 and associated components in the cold state.

In some areas however the temperature is such that certain thermoplastics materials are hard to manipulate in the cold state thus it is desirable that the wedge 52 is formed in a thermoplastics material which becomes pliable when heated to a moderate temperature.

In many instances it is desirable to effect a compressive seal between the wedge 52 and the reglet.

In this regard I have experimented extensively with various forms of thermoplastics materials for use in the manufacture of the wedge and have discovered that some thermoplastics materials are capable of temporary shrinkage when heated with the aid of steam or like heating means.

In a number of instances a shrinkage rate can be achieved whereby the wedge may be dimensionally reduced by up to $\frac{1}{3}$ of its cold state dimensions by steam heating. Thus by manufacturing the wedge so that it has a cold state dimension of up to $\frac{1}{3}$ greater lateral thickness than the opening of the reglet and inserting the wedge into the reglet after it has been shrunk by the application of steam heat, a positive weatherproof seal may be achieved. This is because as the material of the wedge cools down it will increase dimensionally and compressively engage the side walls of the reglet to effect a permanent positive substantially weatherproof seal.

Thus, those skilled in the art will appreciate that the reglet and its associated components in accordance with the invention provide a substantially more efficient means of attaching a flashing to a building than has heretofore been previously known. In addition, it will be appreciated that in a broad form the invention is applicable to a number of different functions.

What I claim is:

1. A reglet comprising first and second wall members of substantially equal length, a web connecting said wall members along adjacent longitudinal edges to form an elongate channel like structure of a pre-determined length; said first wall member comprising a substantially elongate planar element connected along one longitudinal edge to said web and having a width substantially smaller than the overall width of said first wall member, longitudinal flange means connected along one longitudinal edge to the other longitudinal edge of said element, said flange means extending inwardly of said channel like structure toward said second wall member to provide an abutment having a surface facing said web; a second flange portion having a first longitudinal edge connected to said abutment and extending generally normal to said longitudinal flange means in a direction away from said web, said second flange portion having a second longitudinal edge defining the free longitudinal edge of said first wall member and a surface portion substantially parallel to a corresponding surface portion of said second wall member, a plurality of ratchet like elements extending along said surface portion; the spacing between said element and said second wall member being substantially greater than the spacing between said surface portion and said corresponding surface portion of said second wall member, the depth of said ratchet like elements being substantially less than the depth of said abutment surface.

2. A reglet as in claim 1 including a nailing flange extending outwardly of said channel like structure from said second wall member.

3. A weatherproofing system for use in the construction of buildings to seal structural connections therein, said system comprising a reglet as in claim 1, sealing strip means and wedge means; said sealing strip means comprising an elongate element having a longitudinal portion receivable within said channel like structure; said wedge means comprising an elongate element having a front portion receivable within said channel like structure in compressive relationship to said wall members to urge said elongate element into engagement with said second wall member, said front portion including at least an abutment surface adapted to engage with the abutment surface of said first wall member, and a rear portion adapted to be compressively received between said second flange portion and the opposite portion of said second wall member including a plurality of ratchet like elements engageable with the ratchet like elements of said surface portion to compressively retain said wedge means in engagement with said sealing strip means to retain said strip means in said reglet.

4. The weather proofing system of claim 3 wherein said sealing strip means comprise an L-shaped member having an arcuate portion extending along the extremity of one leg thereof, said arcuate portion being adapted to be received within said channel like structure with the free edge of said arcuate portion engaged behind the abutment face of said first member wall.

5. A cushion system, comprising a reglet as in claim 1 adapted to be mounted on a surface with the opening of the channel like structure facing away from said surface, and a cushion member, said cushion member comprising an elongate flexible resilient element having a W-shaped cross-sectional configuration, the center leg of said element being receivable within the channel like structure to securely locate the outer legs of the element in surrounding relationship to said channel like structure; said center leg comprising a front portion having outwardly flared portions defining an arrow head like portion providing abutment surfaces at the rearmost portion of the extremity of said flared portions adapted to engage with the abutment surface of said channel like structure, and a rear portion having outwardly flared ratchet like elements adapted to engage with the ratchet like elements of said channel like structure.

6. A weatherproofing system for a building, comprising a reglet adapted to be embedded in a cast concrete wall relative an area to be protected from the weather, a flashing member adapted to be received in said reglet and including a portion for covering the building area to be protected, a wedge receivable in said reglet to retain said flashing member therein; said reglet comprising first and second elongate wall members arranged in substantially parallel transversely spaced relationship, an elongate substantially transversely curved member connecting adjacent longitudinal edges of said wall members to define an elongate channel like structure, a rib extending along the external surface of said channel in the region of the connection between one said wall member and said curved member to provide an embedment key; said one wall member comprising a substantially planar portion having a wall element extending along the other longitudinal edge thereof and projecting substantially normally from said planar portion towards the other one of said wall members to provide an inner abutment face, a second wall element connected to the inner longitudinal edge of the first said wall element and projecting outwardly of said channel, said second wall element having a substantially flat surface facing said other wall member and extending therealong between said abutment surface and the free longitudinal edge of said second wall element, said second wall element being angled relative to said other wall member to define a channel opening transversely narrower than the distance between said planar portion and said other wall member, a plurality of ratchet like elements along said second wall element between the free longitudinal edge thereof and said substantially flat surface thereof and having a depth less than the depth of said abutment face; said flashing member comprising a substantially L-shaped elongate member, one leg of said L-shaped member having a return bent portion receivable in said channel with the longitudinal edge thereof engaged with said abutment surface, the other leg of said flashing member extending in a direction away from said return bent portion to cover said area to be protected;

said wedge comprising an elongate member having a front portion adapted to engage the bent portion of said flashing member and urge it against the curved member of said reglet, a central portion receivable between opposite legs of the return bent portion of said flashing member to urge said legs into engagement with the wall members of said reglet and retain said longitudinal edge of said flashing behind said abutment face, a rear portion having a plurality of ratchet like elements extending therealong and adapted to engage the ratchet like elements of said second wall element to retain said wedge in said reglet and a rear face portion for closing off the channel opening of said reglet.

* * * * *

UNITED STATES PATENT AND TRADEMARK OFFICE

CERTIFICATE OF CORRECTION

PATENT NO. : 4,055,921

DATED : November 1, 1977

INVENTOR(S) : Arnold Edward Francis de Carteret

It is certified that error appears in the above-identified patent and that said Letters Patent are hereby corrected as shown below:

Column 7, line 32, "member" should be after "wall".

Column 8, line 30, after "elements" insert --extending--.

Signed and Sealed this

*Twenty-seventh* Day of *June 1978*

[SEAL]

*Attest:*

RUTH C. MASON
*Attesting Officer*

DONALD W. BANNER
*Commissioner of Patents and Trademarks*